US009833092B2

(12) United States Patent
Palazzi

(10) Patent No.: US 9,833,092 B2
(45) Date of Patent: Dec. 5, 2017

(54) DRINKING STRAW WITH PIERCING END

(71) Applicant: UNISTRAW HOLDINGS PTE. LTD., Singapore (SG)

(72) Inventor: Kendall Norman Palazzi, Eumundi (AU)

(73) Assignee: Unistraw Holdings Pte. Ltd., Singapore (SG)

( * ) Notice: Subject to any disclaimer, the term of this patent is extended or adjusted under 35 U.S.C. 154(b) by 60 days.

(21) Appl. No.: 14/774,946

(22) PCT Filed: Mar. 13, 2014

(86) PCT No.: PCT/EP2014/054995
§ 371 (c)(1),
(2) Date: Sep. 11, 2015

(87) PCT Pub. No.: WO2014/140199
PCT Pub. Date: Sep. 18, 2014

(65) Prior Publication Data

US 2016/0022070 A1 Jan. 28, 2016

Related U.S. Application Data

(60) Provisional application No. 61/784,440, filed on Mar. 14, 2013.

(30) Foreign Application Priority Data

Jan. 29, 2014 (GB) ..... 1401516.8

(51) Int. Cl.

| | |
|---|---|
| ***A47G 21/18*** | (2006.01) |
| ***A61J 7/00*** | (2006.01) |
| ***B31D 5/00*** | (2017.01) |

(52) U.S. Cl.
CPC ..... *A47G 21/183* (2013.01); *A47G 21/18* (2013.01); *A47G 21/188* (2013.01); *A61J 7/0038* (2013.01); *B31D 5/0095* (2013.01)

(58) Field of Classification Search
CPC ..... B31D 5/0095; A61J 7/0038
(Continued)

(56) References Cited

U.S. PATENT DOCUMENTS 5,820,023 A * 10/1998 Kristensson ..... B65D 77/28 239/33
D427,277 S * 6/2000 Baron ..... D22/128
(Continued)

FOREIGN PATENT DOCUMENTS

CN 1655694 A 8/2005
CN 202553356 11/2012
(Continued)

OTHER PUBLICATIONS

JP 2004-275596 A Translation, published Oct. 7, 2004.*
(Continued)

*Primary Examiner* — Erik Kashnikow
*Assistant Examiner* — Bryan Kim
(74) *Attorney, Agent, or Firm* — Sterne, Kessler, Goldstein & Fox P.L.L.C.

(57) ABSTRACT

A drinking straw includes a generally elongate tube having a sidewall defining an internal bore, wherein one end of the straw is provided with a piercing projection formed from a portion of the sidewall and reinforced by a folded portion of the sidewall. The straw is manufactured from an elongate tube on which a piercing projection is formed at one end by folding a portion of the sidewall at that end to reinforce the projection.

12 Claims, 2 Drawing Sheets

(58) Field of Classification Search
USPC ..... 239/16, 24, 33; D7/300.2
See application file for complete search history.

(56) References Cited

U.S. PATENT DOCUMENTS

| | | | | |
|---|---|---|---|---|
| 6,096,003 | A * | 8/2000 | Wong | A47G 21/183 604/78 |
| 6,685,103 | B2 * | 2/2004 | Hosi | A47G 21/18 239/24 |
| 7,040,547 | B1 | 5/2006 | Nelson | |
| 8,980,348 | B2 | 3/2015 | Baron | |
| 2002/0134850 | A1 | 9/2002 | Hollenberg | |
| 2003/0071136 | A1 * | 4/2003 | Ference | A47G 21/18 239/33 |
| 2004/0222312 | A1 * | 11/2004 | Zuccaro | A47G 21/18 239/33 |
| 2005/0061822 | A1 * | 3/2005 | Naesje | A47G 21/18 220/705 |
| 2005/0106188 | A1 * | 5/2005 | Sedaghat Kerdar | A61J 7/0038 424/400 |
| 2005/0145287 | A1 | 7/2005 | Ottolini et al. | |
| 2008/0197141 | A1 * | 8/2008 | Felfoldi | A47G 21/183 220/705 |
| 2009/0041904 | A1 * | 2/2009 | Baron | A47G 21/183 426/85 |
| 2014/0252115 | A1 * | 9/2014 | Toepfert | A47G 21/188 239/33 |
| 2014/0263718 | A1 * | 9/2014 | Marouthis | A61C 15/02 239/33 |
| 2016/0220049 | A1 * | 8/2016 | Joebges | A47G 19/2222 |

FOREIGN PATENT DOCUMENTS

| | | | | |
|---|---|---|---|---|
| FR | 1 307 555 | A | 10/1962 | |
| JP | 2004-275596 | A * | 10/2004 | A47G 21/18 |
| WO | WO 97/03634 | A1 | 2/1997 | |
| WO | WO 2006/079648 | A1 | 8/2006 | |

OTHER PUBLICATIONS

International Search Report for International Patent Application No. PCT/EP2014/054995, filed Mar. 13, 2014, dated Jun. 16, 2014, European Patent Office, Rijswijk, Netherlands.

* cited by examiner

DRINKING STRAW WITH PIERCING END

TECHNICAL FIELD

The present invention relates generally to drinking straws, particularly though not exclusively filled drinking straws, and methods of making those straws.

BACKGROUND

A drinking straw is a tube intended for transferring a beverage from its container to the mouth of a drinker. In many straws, the tube can be straight or include one or more angle-adjustable bellows segments and/or one or more telescopic sections. A drinker can employ the straw by holding the straw with one end in the mouth and placing another end in the drink. Muscular action by the drinker reduces air pressure in the drinker's mouth, whereupon atmospheric pressure forces the beverage up the straw.

Straws can be used for drinking beverages from containers in which the beverage is accessed by piercing a membrane. The straw can used to pierce the membrane and one end may be adapted for this purpose. Typically the straw will be cut at an angle at one end creating a point, which is designed for use in piercing the membrane. However, such points are not very strong, especially when formed in straws with a larger diameter (typically 7-15 mm), and do not always pierce the membrane easily, preventing access to the beverage. When too much force is used for piercing, this can lead to excess pressure on the container, breaking of the straw or its point, and/or spilling of the beverage when piercing is achieved.

The object of the present invention is to provide an alternative and, in embodiments, an improved straw, in particular one including an end adapted for piercing a membrane.

SUMMARY

According to the invention there is provided a drinking straw comprising a generally elongate tube having a sidewall defining an internal bore, wherein one end of the straw is provided with a projection formed from a portion of the sidewall and reinforced by a folded portion of the sidewall.

A drinking straw according to embodiments of the invention includes a body, comprising a tube having a sidewall defining an internal bore, and an end; wherein the end comprises a piercing projection formed in or from the tube and extending from the tube end, said projection being formed in the sidewall and reinforced by a folded portion of the sidewall.

In another aspect of the invention, a drinking straw includes a generally elongate tube having a sidewall defining an internal bore, and an end feature including a lip portion formed from a roll of the sidewall back upon itself and a beak forming a point.

One or more of the following features can be included, in relation to all aspects. For example, the sidewall can roll into an interior of the elongate tube. The point can be suitable for puncturing a frangible membrane. A quantum of polymer in the straw can be minimized. The internal bore can be between 3 mm and 15 mm in diameter. The sidewall thickness can be between 0.1 mm and 0.5 mm. Where telescopic straws are provided, they may have thicker walls. Typically a wall thickness may be of the order of 0.25 mm. The drinking straw can further include a plurality of pellets containing a measure of soluble active ingredient, and a filter system that retains the pellets substantially within the tube while allowing a carrier liquid to be drawn through the tube by oral suction. The filter system is known from existing straws and can be formed from or in the tube walls or can be provided by filter elements added into the tube.

The subject matter described herein provides many advantages. For example, a projection, beak or rigid point that is reinforced by material, rather than an angled cut that removes material, provides a reliable and effective drinking straw sharp end. Furthermore, the drinking straw end feature can be formed integrally from an end of the straw and as such does not require any additional parts or components nor the generation of potentially hazardous small particles or fragments. The end feature may be in the form of a lip portion defining a cavity.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Figure 1:
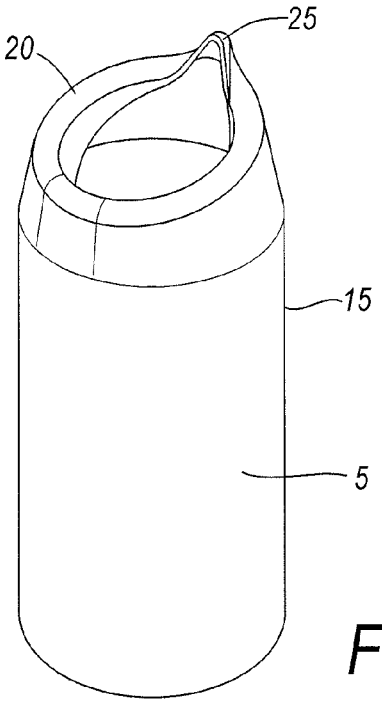
FIG. 1 is a perspective view or illustration of an end of a drinking straw with a projection or beak.

Straws may be used to drink liquids packaged in containers or cartons that include a frangible membrane such as a region or portion of the container that is thinner or weaker or otherwise designed to be punctured by an accompanying pointed straw. The membrane is thus typically sized on the carton to be pierced by and to accommodate a correspondingly sized drinking straw. Conventional straws used in this context are cut at an oblique angle to provide a sharpened end adapted to facilitate piercing of the carton membrane. However, in order to reduce costs, many straws are manufactured with thin walls and/or weak material (e.g., the quantum of polymer in the straw is minimized). Thin walled straws are weak and subsequently ineffective as a tool for puncturing a membrane when the end is cut at an angle. When pressure is applied by a user to the membrane using a weak straw, the straw is liable to bend, frustrate the user, inhibit drink consumption, and diminish the drinking experience.

Larger diameter straws (e.g., between 7 mm and 15 mm in diameter) are becoming more frequently utilised as they may allow for a better drinking experience and more beverages are being marketed with higher viscosities and added matter such as pieces of fruit and jelly. These larger diameter straws also tend to be ineffective as a tool for puncturing the membrane when the straw end is cut at an angle.

Hence the invention provides a drinking straw comprising a generally elongate tube having a sidewall defining an internal bore, wherein one end of the straw is provided with a projection formed from a portion of the sidewall and reinforced by a folded portion of the sidewall. While the folded portion will usually be folded into the interior of the elongate tube, in an alternative the folded portion may be folded onto an exterior of the elongate tube. In some embodiments the projection may be further shaped by cutting or bending.

Drinking straws having the projection may typically have an internal bore having a diameter of 3-15 mm. In addition, they will usually have a sidewall thickness of between 0.1 and 0.5 mm.

The invention is particularly advantageous for use with larger diameter straws, such as filled drinking straws. The straw of the invention may further comprise a plurality of pellets containing soluble active ingredient and a filter system that retains the pellets substantially within the tube while allowing a carrier liquid to be drawn through the tube by oral suction.

The straws of the invention may be manufactured by providing an elongate tube having a sidewall defining an internal bore; at one end, forming a piercing projection from the sidewall, and folding a portion of the sidewall to reinforce the piercing projection. The sidewall may be folded back on itself around a substantial portion of the circumference, the portion of the sidewall that is not folded back on itself forming the projection and being reinforced by folded back portions on either side. While usually the folded portion will be folded into an interior of the internal bore, alternatively the folded portion may be folded onto an exterior of the sidewall.

Typically the unfolded portion of the sidewall may be substantially up to 60 degrees, more generally 5-45 degrees of the circumference, and usually approximately 10-40 degrees. Effective piercing straws of separate examples of the invention made and tested to date have unfolded portions of about 5, about 10 and about 30 degrees of the circumference.

To create a filled drinking straw, the straw may further include soluble active ingredient within the body; and filtration means disposed to retain the soluble active ingredient within the body. Typically, the body may be an elongate tubular body containing a plurality of pellets comprising the soluble active ingredient; the filters may be disposed at or adjacent the ends of the tubular body to retain the pellets within the body; and the body and the filters may be sized and arranged to allow a carrier liquid to be drawn therethrough such that passage of the liquid through the tube causes the pellets to dissolve thereby releasing active ingredient into the liquid.

Additionally the end that is not pointed may be reinforced by a portion of sidewall folded back into the tube, which gives a smooth end to the straw, enhancing the feel of the straw in a user's mouth, does not increase the tube diameter and can help retain the filter in the tube at that end.

To aid piercing of a frangible membrane the projection may be sharp and pointed.

A straw according to the invention may be made by a method including the steps of providing a drinking straw comprising a tube; forming a piecing projection that extends from the tube outwardly; and folding a portion of a tube sidewall to reinforce the projection. Where the straw is a filled straw, the straw can comprise a body, containing soluble active ingredient; filters disposed to retain the soluble active ingredient within the body, and an exit, e.g. comprising a tube having a sidewall defining an internal bore, through which beverage is consumed by a user.

Manufacturing straws of the invention may comprise forming an elongate tube having a side wall defining an internal bore, as is standard in the manufacture of drinking straws. One end of the sidewall is then folded or rolled back on itself around a significant part of the circumference, by pressing the end of the straw against a heated forming tool. The unrolled portion forms the beak or piercing element, which is reinforced by the folded portions adjacent to it. Generally the unfolded portion of the circumference will be approximately 5-45 degrees, and preferably 20-40 degrees of the circumference.

The beak can be further shaped by cutting or bending to create various shapes if desired.

While the fold may be a hard or sharp fold, with the edge of the fold having a minimum radius of curvature and the folded portion lying almost flat against an unfolded portion, usually the fold will be a soft fold, having a significant radius of curvature. Such folds are shown in the drawings. This creates a rounder edge to the fold, providing stiffness to the straw.

Figure 2:
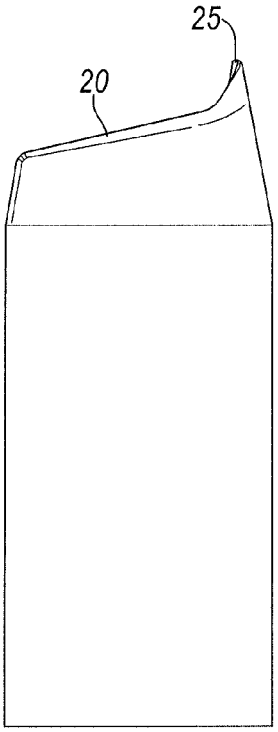
FIG. 2 is a side view of the end of the drinking straw.
Figure 3:
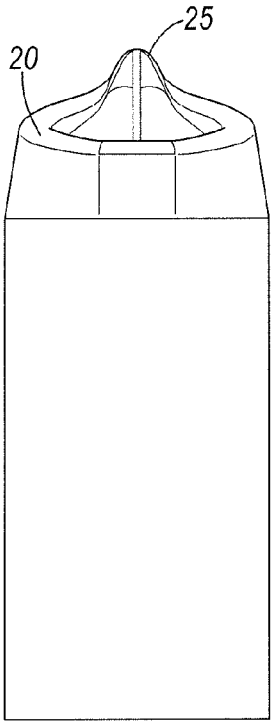
FIG. 3 is another side view of the end of the drinking straw.
Figure 4:
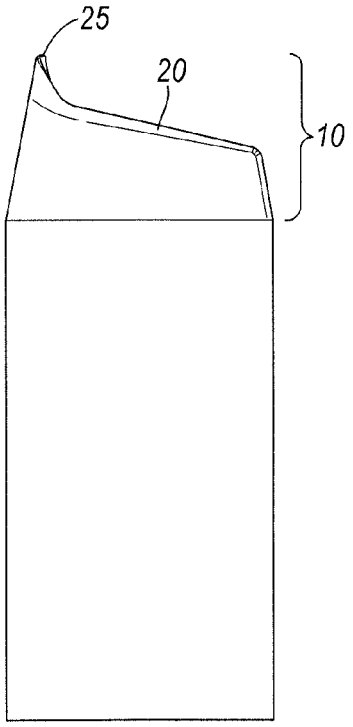
FIG. 4 is yet another side view of the end of the drinking straw.
Figure 5:
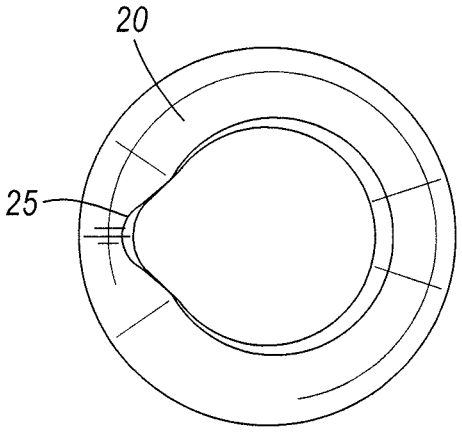
FIG. 5 is a top view of the end of the drinking straw.
Figure 6:
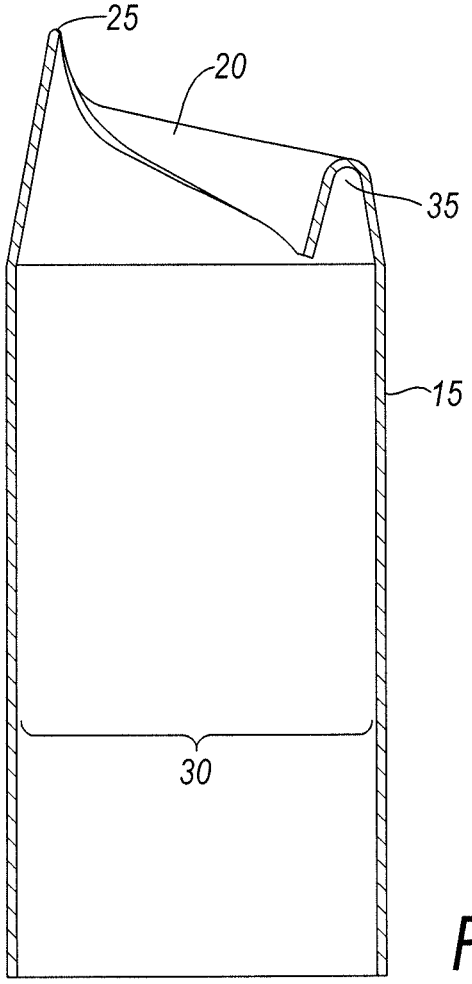
FIG. 6 is a partially cut-away side view corresponding to FIG. 4.

FIG. 1 is an illustration of an end of a drinking straw with a projection designed for piercing a frangible membrane in a container. This projection may be referred to as a beak. FIGS. 2-4 are illustrations showing the drinking straw from different side angles, FIG. 5 is an illustration showing the drinking straw from above, and FIG. 6 is a cut-away cross section of the drinking straw.

A drinking straw includes a generally elongated hollow tube 5 having a sidewall 15 defining an internal bore 30. The straw includes an end feature 10 including the projection, where the sidewall 15 is folded to form a lip 20 and a rigid projection or beak 25. The lip 20 is a folded or rolled portion of the end feature 10 that folds, rolls or turns the sidewall 15 back upon itself, around a significant portion of the circumference of the sidewall. The sidewall 15 feeds into the interior of the elongated hollow tube 5 thereby forming the lip 20. The lip 20 can define a cavity 35.

The projection or beak 25 is a portion of the lip that does not feed into the interior of the elongated hollow tube 5 but forms a rigid point, the point being reinforced by the adjacent part of the folded sidewall 15. This projection or beak is designed for piercing a frangible membrane. The end feature 10 can taper slightly along its length.

The shape of the beak 25 may vary. For example, the point may be dull or flattened to improve safety. Some implementations may have a sharp point, or the sharp point may be recessed or angled from the main axis of the hollow tube 5.

The end feature 10 is 5 mm in length from the end of the beak 25 to the tube 5, and tapers at an angle of 10 degrees (with respect to the tube axis). The lip 20 in the sidewall 15 has a radius of 0.5 mm and the roll length tapers from 2.5 mm at the widest to 0 mm at the tip of the projection or beak 25. The portion of the lip 20 that is not folded or turned back upon itself (i.e., not rolled) is about 30 degrees of the circumference of the end feature 10.

The end feature 10 of the straw provides a rigid sharp tip for puncturing a frangible membrane. When the straw has a thin wall and/or a large diameter, the end feature 10 is sufficient to enable the straw to be an effective tool for puncturing a frangible membrane. The end is thus effectively sharpened due to the rigidity imparted by the reinforcing fold.

By providing a reinforced point, rather than an angled cut, the straw provides a safe, reliable and effective tool for puncturing frangible membranes. Additionally, an end feature 10 with projection or beak 25 adds a high quality look and feel to the straw, which improves the drinking experience. The end feature 10 can be formed integrally from the end of the straw and as such does not require any additional parts or components nor the generation of potentially hazardous small particles or fragments.

Plastic straws generally can have a tube diameter between 3 mm to 15 mm, with a length that is greater than the diameter. Larger straws are generally between 7 mm and 15 mm in diameter, although the current subject matter can be applicable to straws with any sized diameter.

Many straw sidewall thicknesses can be between 0.1 mm and 0.5 mm. Many straws are hollow cylinders (e.g., a round tube). However, straws can take other shapes, such as, but not limited to, triangular tubes, rectangular tubes, square tubes, oval tubes, hexagonal tubes, etc. The straw can be a combination of multiple shapes, such as square with rounded corners. Other shapes are possible and the size and shape may vary along the straw.

The invention is particularly useful in straws having large diameters. In such straws, cutting one end at an angle produces a very weak point, which may be ineffective in piercing a frangible membrane. Filled straws, in particular straws filled with a soluble active ingredient designed to dissolve into liquid drawn through the straw by a user, generally have a diameter of 7-15 mm, to accommodate the filling.

In use, a user may apply the piercing projection or beak to the frangible membrane of a liquid container, piercing the membrane. He may then draw liquid from the container through the straw, the liquid dissolving the active ingredient, adding flavour, nutrient and/or pharmaceutical content to the liquid.

In the embodiment shown in the drawings, the sidewall is folded inwards to create the rigid projection 25. However, in other embodiments the sidewall may be folded outwards (not shown). This creates a diameter which is slightly larger than the diameter of the main elongate tube. Once the straw has been used to pierce a membrane to access a beverage, the straw is likely to catch on the edge of the membrane if attempts are made to pull the straw out of the container, making removal of the straw more difficult and accidental removal less likely.

Various implementations of the subject matter described herein may be realized. For example, the current subject matter can be applied to plastic straws, paper straws, bioplastic straws, glass straws, and metal straws (e.g., stainless steel straws). Other straw features may be included with the present subject matter such as a flavour straw, an articulated straw, a telescopic straw, a bendable straw and a "crazy straw" (having a number of twists and turns at the top). Flavour straws progressively add active ingredients to a carrier liquid (i.e., the liquid being consumed using the drinking straw) as the liquid is drawn through the straw. The straw includes filter elements disposed adjacent to the ends of the elongated tube. The filters retain the active ingredient in the form of solid pellets.

Although a few variations have been described in detail above, other modifications are possible. Other embodiments may be within the scope of the following claims.

The invention claimed is:

1. A drinking straw comprising a generally elongate tube having a sidewall defining an internal bore, wherein one end of the straw is provided with a projection formed from a portion of the sidewall and reinforced by a folded portion of the sidewall, wherein the sidewall is folded back on itself around a substantial portion of the circumference, wherein the projection comprises an apex, wherein the apex is an unfolded portion of the sidewall, wherein the portion of sidewall opposite the apex is folded back on itself, and wherein the fold is progressively decreased along the circumference of the sidewall in both directions until the apex is reached.

2. The drinking straw of claim 1, wherein the folded portion is folded into an interior of the elongate tube.

3. The drinking straw of claim 1, wherein the projection is further shaped by cutting or bending.

4. The drinking straw of claim 1, wherein the internal bore has a diameter of 3-15 mm.

5. The drinking straw of claim 1, further comprising:

a plurality of pellets containing soluble active ingredient; and a filter system that retains the pellets substantially within the tube while allowing a carrier liquid to be drawn through tube by oral suction.

6. A method of manufacturing the drinking straw of claim 1 comprising: providing an elongate tube having a sidewall defining an internal bore; at one end, forming a piercing projection from the sidewall, and folding a portion of the sidewall to reinforce the piercing projection, wherein the sidewall is folded back on itself around a substantial portion of the circumference, the portion of the sidewall that is not folded back on itself forming the projection and being reinforced by folded back portions on either side.

7. The method of claim 6, wherein the folded portion is folded into an interior of the internal bore.

8. The method of claim 6, wherein the unfolded portion of the sidewall is substantially 5-45 degrees of the circumference.

9. The drinking straw of claim 1, wherein the projection is reinforced by folded portions of the sidewall adjacent the projection.

10. The method of manufacturing a drinking straw of claim 6, wherein the folded portion is adjacent the piercing projection.

11. The drinking straw of claim 1, wherein the portion of the sidewall that is not folded back on itself is up to 60 degrees of the circumference of the sidewall.

12. The drinking straw of claim 1, wherein the portion of the sidewall that is not folded back on itself is 5-45 degrees of the circumference of the sidewall.

* * * * *